US010618105B2

(12) United States Patent
Fent et al.

(10) Patent No.: US 10,618,105 B2
(45) Date of Patent: Apr. 14, 2020

(54) CASTING DEVICE AND CASTING METHOD

(71) Applicant: Bayerische Motoren Werke Aktiengesellschaft, Munich (DE)

(72) Inventors: Andreas Fent, Straubing (DE); Richard Schaechtl, Pfeffenhausen (DE); Hubert Lang, Landshut (DE); Marcus Stier, Ergoldsbach (DE); Thomas Summer, Hohenthann (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 355 days.

(21) Appl. No.: 14/920,185

(22) Filed: Oct. 22, 2015

(65) Prior Publication Data

US 2016/0038995 A1 Feb. 11, 2016

Related U.S. Application Data

(63) Continuation of application No. PCT/EP2014/064528, filed on Jul. 8, 2014.

(30) Foreign Application Priority Data

Jul. 25, 2013 (DE) ..... 10 2013 214 534

(51) Int. Cl.
*B22C 9/10* (2006.01)
*B22C 9/06* (2006.01)
(Continued)

(52) U.S. Cl.
CPC ..... *B22C 9/101* (2013.01); *B22C 9/02* (2013.01); *B22C 9/06* (2013.01); *B22C 9/065* (2013.01);
(Continued)

(58) Field of Classification Search
CPC .. B22C 9/101; B22C 9/02; B22C 9/06; B22C 9/065; B22D 15/02; B22D 117/2069; B22D 27/11; B22D 17/2069
See application file for complete search history.

(56) References Cited

U.S. PATENT DOCUMENTS 3,664,410 A 5/1972 Groteke
4,846,252 A 7/1989 Sato et al.
(Continued)

FOREIGN PATENT DOCUMENTS

CH 236619 7/1945
CH 267159 6/1950
(Continued)

OTHER PUBLICATIONS

International Search Report (PCT/ISA/210) issued in PCT Application No. PCT/EP2014/064528 dated Sep. 19, 2014, with English translation (four (4) pages).
(Continued)

*Primary Examiner* — Kevin P Kerns
*Assistant Examiner* — Steven S Ha
(74) *Attorney, Agent, or Firm* — Crowell & Moring LLP

(57) ABSTRACT

A casting device and casting method are provided for producing components, in particular cylinder heads. The device includes a reusable steel upper core, which can be lifted off from the component to be produced and which has a movable displacing element. The displacement element can be pressed into the component to be produced for dense feeding. In a method for producing a cylinder head by casting, wherein the steel upper core is used as a substitution for a sand cover core, for dense feeding the displacing element is pressed into the melt that forms the cylinder head in the solidified state.

7 Claims, 4 Drawing Sheets

(51) Int. Cl.

| | |
|---|---|
| ***B22C 9/02*** | (2006.01) |
| ***B22D 27/11*** | (2006.01) |
| ***B22D 15/02*** | (2006.01) |
| ***B22D 25/02*** | (2006.01) |

(52) U.S. Cl.
CPC ..... *B22D 15/02* (2013.01); *B22D 25/02* (2013.01); *B22D 27/11* (2013.01)

(56) References Cited

U.S. PATENT DOCUMENTS

| | | | | |
|---|---|---|---|---|
| 4,875,518 | A | 10/1989 | Imura et al. | |
| 6,422,294 | B1 * | 7/2002 | Murata ..... | B22D 18/04 164/113 |
| 6,588,487 | B2 | 7/2003 | Crafton et al. | |
| 2001/0054492 | A1 | 12/2001 | Hanano | |
| 2007/0102131 | A1 | 5/2007 | Raffle | |
| 2008/0053637 | A1 * | 3/2008 | Hamasaki ..... | B22D 27/11 164/113 |

FOREIGN PATENT DOCUMENTS

| | | | |
|---|---|---|---|
| CN | 101954469 | A | 1/2011 |
| CN | 102029383 | A | 4/2011 |
| CN | 102641996 | A | 8/2012 |
| DE | 20 28 855 | | 12/1970 |
| DE | 38 28 739 | A1 | 3/1989 |
| DE | 198 03 397 | A1 | 8/1999 |
| DE | 100 17 151 | A1 | 11/2000 |
| DE | 100 11 221 | A1 | 9/2001 |
| DE | 10 2006 036 369 | A1 | 2/2008 |
| DE | 60 2004 007 162 | T2 | 2/2008 |
| DE | 10 2006 057 786 | A1 | 6/2008 |
| EP | 0 433 125 | B1 | 12/1993 |
| JP | 48-55011 | | 7/1973 |
| JP | 51-16347 | Y2 | 4/1976 |
| JP | 2004-230403 | A | 8/2004 |
| JP | 2008-73763 | A | 4/2008 |
| WO | WO 2012/175836 | A2 | 12/2012 |

OTHER PUBLICATIONS

German Search Report issued in counterpart German Application No. 10 2013 214 534.9 dated Feb. 4, 2014, with partial English translation (ten (10) pages).

Chinese-language Office Action issued in counterpart Chinese Application No. 201480030963.4 dated Aug. 29, 2016 with English translation (12 pages).

Chinese Office Action issued in Chinese counterpart application No. 201480030963.4 dated Jan. 16, 2019, with partial English translation (Fourteen (14) pages).

* cited by examiner

CASTING DEVICE AND CASTING METHOD

CROSS REFERENCE TO RELATED APPLICATIONS

This application is a continuation of PCT International Application No. PCT/EP2014/064528, filed Jul. 8, 2014, which claims priority under 35 U.S.C. § 119 from German Patent Application No. 10 2013 214 534.9, filed Jul. 25, 2013, the entire disclosures of which are herein expressly incorporated by reference.

BACKGROUND AND SUMMARY OF THE INVENTION

The invention relates to a casting device and a casting method for manufacturing or completing a cylinder head, respectively.

In gravity casting of cylinder heads, a comparatively heavy sand cover core of large volume in which a feeder system is integrated is conventionally used. The feeder system, inter alia, serves in compensating for shrinkage of the casting during cooling and for avoiding shrinkholes in the interior of the setting casting. In the manufacture of a cylinder head of a four-cylinder engine, the feeder system has a melt volume of about 14 kg, and in the case of 6-cylinder cylinder heads a melt volume of approx. 20 kg. The large amount of melt volume is required in order to ensure that the melt in the feeder is still liquid when the component to be produced has been completed. On account thereof, compensation via the feeder system for shrinkage may be ensured at all times. The feed system is conventionally surrounded by the sand cover core and, on account thereof, is also thermally insulated.

It is disadvantageous in the known solution that both components, feeder and sand cover core, have a heavy weight which has to be processed in the method. This leads to a large amount of circulating material and to long cycle times.

Against this background it is an object of the invention to provide a device by way of which components may be manufactured by gravity casting, without the previous large and heavy feeder systems which limit the cycle time in production that must be employed. It is furthermore an object of the invention to provide a method for manufacturing components of this type, in particular cylinder heads.

This and other objects according to the invention are achieved by a casting device and a casting method for producing components, in particular cylinder heads, having a reusable upper steel core which is liftable from the component to be produced and which has a movable displacement element. The displacement element is pressable into the component to be produced.

Here, provision is made for a casting device for producing components, in particular cylinder heads. The casting device has a reusable upper steel core which is liftable from the component to be produced and which has a movable displacement element which is pressable into the component to be produced. The sand cover core, having an integrated feeder system, which is used in the method according to the prior art, is entirely substituted by the upper steel core. A feeder system in the context of the prior art becomes obsolete. The upper steel core—instead of the previously used sand cover core—is placed onto the component to be produced and reproduces the surface contour of the latter as a negative. For dense feeding, a displacement element is pressed into the component to be produced which has not yet set (melt), on account of which the volume of melt in the displacement element is displaced. This displaced melt volume serves as a replacement for the melt which is otherwise added via the feeders. Dense feeding is thus performed using melt material which has been originally provided by the component to be produced per se. It may be provided here that a minutely increased processing addition in terms of melt material is provided on the upper flange faces.

In one favorable embodiment according to the invention, it is provided that the displacement element is disposed at a position of the upper steel core which correlates with a position of the component to be produced which, in a final state of the component to be produced, forms a clearance. Pressing the displacement element into the component to be produced is thus simultaneously a manufacturing step of a clearance in the component to be produced. In the manufacture of a cylinder head it is favorably provided that the position of the displacement element corresponds to the position of the spark-plug well of the cylinder head. The number of displacement elements in such a case depends on the number of cylinders of the cylinder head.

In the production of such a spark-plug well it is favorable that the displacement element is configured as a movable steel pin which is pressable into the melt of the cylinder head and there causes a cylindrical clearance.

In one embodiment it is furthermore provided that the displacement element is equipped with a cooling unit and/or heating unit. The cooling unit is configured in order for air, water, or oil as a coolant to be directed past the displacement element by way of internal ducts for example, so as to cool the displacement element. In one potential embodiment, a heating cartridge is integrated as a heating unit in the displacement element. The displacement element may be cooled and/or heated in this way, and the influence on the melt in the region of the displacement element may be selectively and individually adapted.

A method for manufacturing a cylinder head by the casting method is likewise part of the invention. As a substitute for a sand cover core, a reusable upper steel core is used. The steel cover core is liftable from the component to be produced and has a displacement element which, for dense feeding, is pressed into a melt which in the solidified state forms the cylinder head. It is provided according to the invention in the method that the displacement element is only pressed into the cylinder head after the melt has cooled off to the extent that an external skin has formed thereon. This is therefore favorable in that a wall shell is present on the sand core and the melt is not pressed into the sand core of the cylinder head.

The advantages of the device according to the invention and of the method according to the invention lie, in particular, in that the previously required sand cover core having an integrated feeder system is entirely replaced by a single upper steel core. The upper steel core according to the invention is capable of integration into the casting system, is reusable, and is liftable from the component to be produced. The feeder volume which is provided by the component to be produced per se corresponds to only 10 to 15% of the original volume which was previously provided in feeders. On account of the reduced melt volume, setting is more rapid and cycle times are shorter. Where the space which is displaced by the displacement element is utilized (for example as a spark-plug well), a subsequent machining process may be avoided.

Other objects, advantages and novel features of the present invention will become apparent from the following detailed description of one or more preferred embodiments when considered in conjunction with the accompanying drawings.

BRIEF DESCRIPTION OF THE DRAWINGS

The figures are exemplary and schematic. Same reference signs refer to same parts in all figures.

DETAILED DESCRIPTION OF THE DRAWINGS

Figure 1:
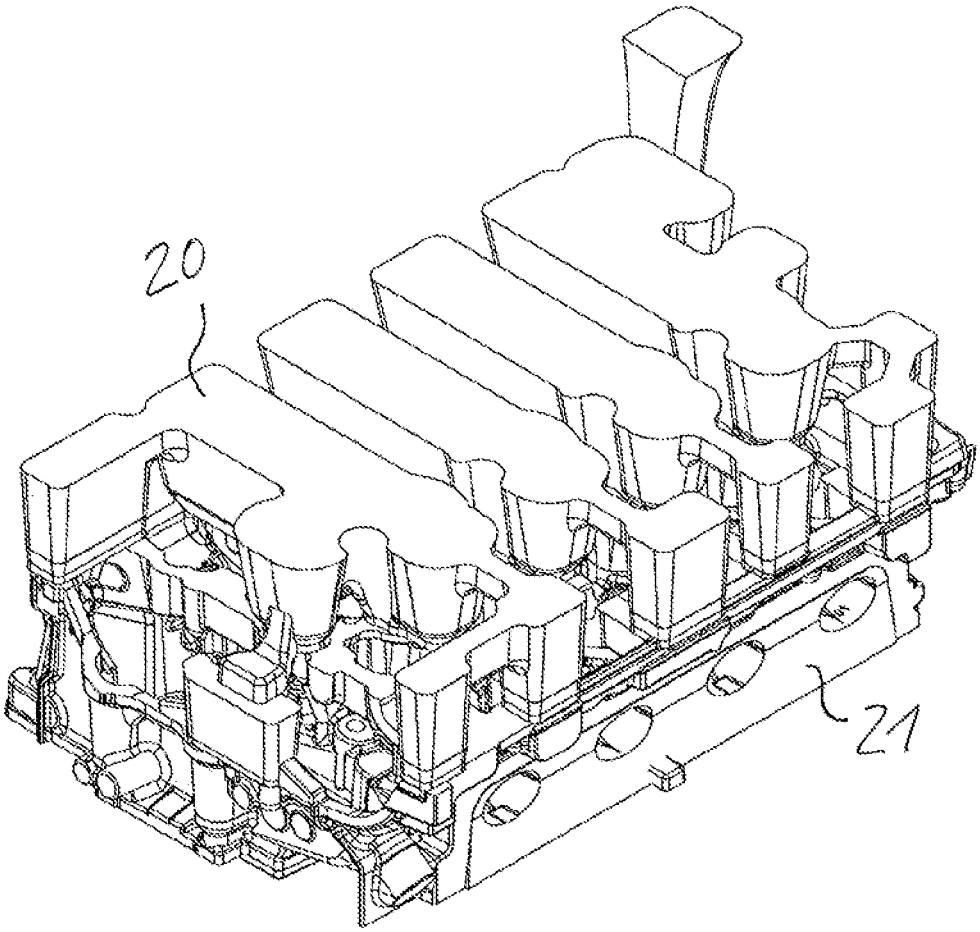
Figure 1 Prior Art
FIG. 1 is a perspective view of a cylinder head having a feeder system according to the prior art.

A cylinder head 21 having a feeder system 20 disposed thereon is illustrated in a perspective view in FIG. 1. The feeder system 20, presently for a four-cylinder engine, contains the melt which compensates for the shrinkage of the setting component and ensures dense feeding. The feeder system 20 is surrounded by a sand cover core (not illustrated), which forms the upper termination face for the cylinder head 21 and receives the feeder system 20. The sand cover core and the feeder system 20 have a significant volume and weight.

Figure 2:
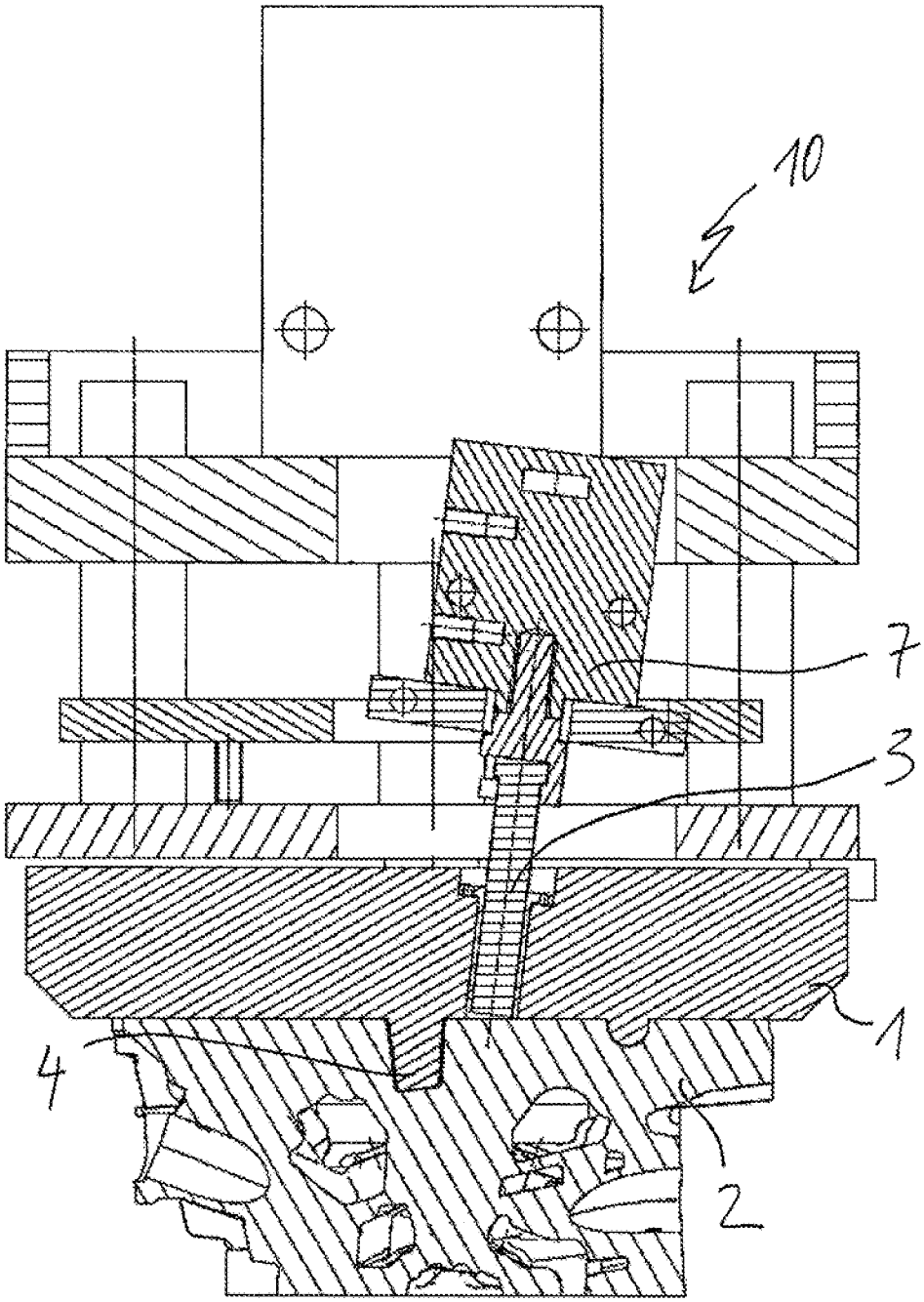
FIG. 2 is a sectional view of a casting device according to an embodiment of the invention for casting a cylinder head.

The casting device 10 according to an embodiment of the invention is illustrated in a lateral sectional view in FIG. 2, components which are irrelevant to the invention being omitted. The casting device 10 has a reusable upper steel core 1 which is liftable from the cylinder head 2 and through which a plurality of displacement elements 3, which are configured as steel pins, extend. The displacement elements 3 are movable and, by way of a controller device 7, pressable into the cylinder head 2 at a predetermined time and at a predetermined pressure. A predetermined time here means that the melt of the cylinder head 2 must not yet have set, such that the penetrating displacement element 3 leads to displacement of melt. The excess melt which is obtained by displacement is substantially distributed across the entire cylinder head 2 and serves as dense feeding. The feeder system 20 from FIG. 1 is thus obsolete.

Figure 3:
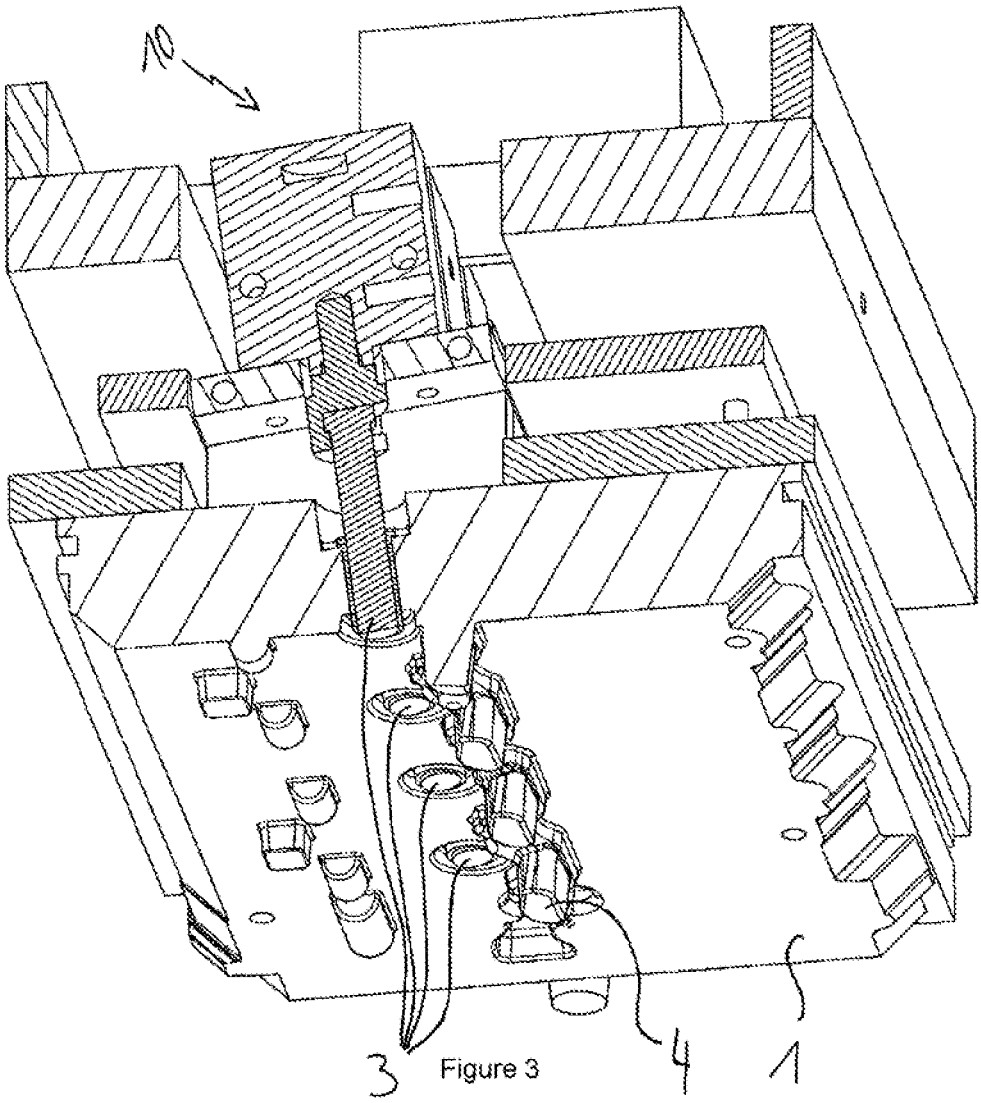
FIG. 3 is a perspective view of the casting device from FIG. 2.

The casting device 10 from FIG. 2 is illustrated in a perspective view in FIG. 3. The upper steel core 1 can be seen from its lower side which faces the cylinder head 2. The position of the displacement elements 3 is selected so as to correlate with positions of the cylinder head 2. The position of the displacement elements 3, in the finished state, in each case form the spark-plug well. The upper steel core 1 on the surface thereof which faces the cylinder head 2 additionally has a plurality of protrusions 4 which, in the finished state of the cylinder head 2, form a cavity. The surface geometry of the upper steel core 1 may thus be selected such that a negative of the component to be produced, presently the cylinder head 2, is formed.

Figure 4:
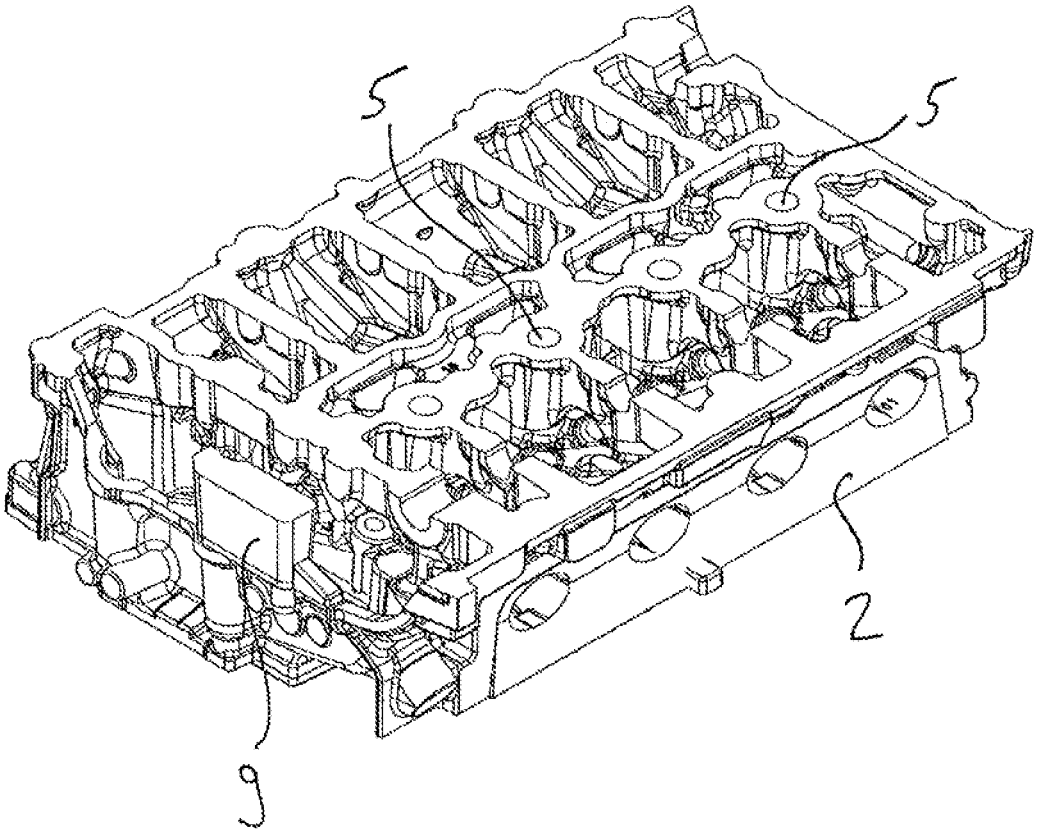
FIG. 4 is a perspective view of a cylinder head from FIG. 2.

FIG. 4 shows a perspective view of a cylinder head 2, including the positions 5 which correlate with the displacement elements 3 and which form the spark-plug wells in the cylinder head 2. An illustration of the sand core for forming the remaining cavities within the cylinder head 2 has been dispensed with. The illustrated basic mold is cast as usual in order for the cylinder head 2 to be manufactured. However, in order to ensure dense feeding, the feeder system 20 from FIG. 1 is no longer used, but instead the displacement elements 3 which are integrated into the upper steel core 1 are pressed into the partially set melt of the cylinder head 2. The casting device 10, by way of the upper steel core 1, seals tightly the component to be produced, such that the internal pressure rises on account of the displacement elements 3 being pressed in. On account of this, material shrinkage of the melt is equalized. As soon as the melt has sufficiently set such that the displacement elements 3 can be retracted again into the upper steel core 1 without causing deformation in the respective regions, the upper steel core may be lifted and the component, presently the cylinder head 2, may be removed.

According to the invention, the use of an additional feeder system 9 on a component to be produced is not excluded, in particular in regions which are not in direct fluid connection with the positions 5. This means that an additional feeder system 9 may readily be disposed in regions which cannot be reached by the displaced melt material. However, in comparison with the feeder systems according to FIG. 1, the additional feeder system, in terms of the volume and weight thereof, is minimal.

The invention in its embodiment is not limited to the above-stated and preferred embodiment. Rather, numerous variants which utilize embodiments which may differ in principle from the illustrated solution are contemplated. For example, the displacement element need not form a spark-plug well but, by pressing, may vacate any other clearances desired in the component to be produced.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of manufacturing a cylinder head by a casting method, the method comprising the acts of:

providing a reusable upper steel core, rather than a sand cover core, configured to be liftable from the cylinder head to be produced, the reusable upper steel core having a movable displacement element; and pressing the movable displacement element into a melt which, in a solidified state, forms the cylinder head to be produced, such that as a result of the pressing of the movable displacement element into the melt, melt that is displaced by the pressing is distributed across an entirety of the cylinder head to be produced and a manufacturing step is performed where a clearance in the cylinder head to be produced is formed.

2. The method according to claim 1, further comprising the act of:

cooling and/or heating the displacement element.

3. A method of manufacturing a cylinder head by a casting method, the method comprising the acts of:

providing a reusable upper steel core, rather than a sand cover core, configured to be liftable from the cylinder head to be produced, the reusable upper steel core having a movable displacement element; and pressing the movable displacement element into a melt which, in a solidified state, forms the cylinder head to be produced, such that as a result of the pressing of the movable displacement element into the melt, melt that is displaced by the pressing is distributed across an entirety of the cylinder head to be produced;

wherein the displacement element is configured as a steel pin and is pressed into the cylinder head to be produced at a position forming a spark-plug well.

4. A method of manufacturing a cylinder head by a casting method, the method comprising the acts of:

providing a reusable upper steel core, rather than a sand cover core, configured to be liftable from the cylinder head to be produced, the reusable upper steel core having a movable displacement element; and pressing the movable displacement element into a melt which, in a solidified state, forms the cylinder head to be produced, wherein the displacement element is configured as a steel pin and is pressed into the cylinder head to be produced at a position forming a spark-plug well.

5. The method according to claim 4, further comprising the act of:

cooling and/or heating the displacement element.

6. A method of manufacturing a cylinder head by a casting method, the method comprising the acts of:

providing a reusable upper steel core, rather than a sand cover core, configured to be liftable from the cylinder head to be produced, the reusable upper steel core having a movable displacement element; and pressing the movable displacement element into a melt which, in a solidified state, forms the cylinder head to be produced, wherein the displacement element is pressed into the cylinder head to be produced at a position which, in a final state, forms a clearance in the cylinder head.

7. The method according to claim 6, wherein the clearance is a spark-plug well.

* * * * *